US009844238B2

(12) United States Patent
Lemoine et al.

(10) Patent No.: US 9,844,238 B2
(45) Date of Patent: Dec. 19, 2017

(54) ATTACHMENT SYSTEM FOR A HELMET

(71) Applicant: BAUER HOCKEY CORP., St-Jerome (CA)

(72) Inventors: Glen Lemoine, St-Jerome (CA); Charles-Antoine Desrochers, Prevost (CA); David Rudd, Vaudreuil-Dorion (CA)

(73) Assignee: BAUER HOCKEY, LLC, Exeter, NH (US)

( * ) Notice: Subject to any disclaimer, the term of this patent is extended or adjusted under 35 U.S.C. 154(b) by 56 days.

(21) Appl. No.: 14/477,052

(22) Filed: Sep. 4, 2014

(65) Prior Publication Data

US 2016/0066641 A1 Mar. 10, 2016

(51) Int. Cl.

| | |
|---|---|
| ***A44B 17/00*** | (2006.01) |
| ***A42B 3/04*** | (2006.01) |
| ***A42B 3/08*** | (2006.01) |
| ***A44B 11/25*** | (2006.01) |
| ***A44B 11/26*** | (2006.01) |

(52) U.S. Cl.

CPC ..... *A42B 3/08* (2013.01); *A44B 11/2596* (2013.01); *A44B 11/26* (2013.01); *A44B 17/0023* (2013.01)

(58) Field of Classification Search

CPC ..... A42B 3/08; A42B 3/205; A42B 3/085; A44B 11/04; A44B 11/2596; A44B 11/2592; A44B 17/0076; A44B 11/26; A44B 17/0023; A44B 11/006; A44B 11/25; A45C 13/1092; A45C 13/1084; Y10T 24/3416; Y10T 24/3423; Y10T 24/3424; A63B 71/10

USPC ..... 2/421, 425; 116/278, 307, 200, DIG. 6, 116/DIG. 17

See application file for complete search history.

(56) References Cited

U.S. PATENT DOCUMENTS

| | | | | |
|---|---|---|---|---|
| 2,867,811 A * | 1/1959 | Jones | A42B 3/08 2/421 |
| 4,686,712 A | 8/1987 | Spiva | |
| 6,254,302 B1 * | 7/2001 | Kraus | F16B 5/0628 248/221.12 |
| 6,536,371 B2 * | 3/2003 | Brazell | B23Q 17/2404 116/284 |
| 7,246,384 B2 | 7/2007 | Bentz | |
| 2010/0132095 A1 | 6/2010 | Gafforio et al. | |

(Continued)

FOREIGN PATENT DOCUMENTS

| | | | |
|---|---|---|---|
| GB | 366391 A * | 2/1932 | A44B 11/006 |
| WO | WO 2010076817 | 7/2010 | |

*Primary Examiner* — Jack W Lavinder

(57) ABSTRACT

An attachment system for a helmet, the system having a buckle and a stud. The stud has an engaging portion and the buckle extends along a longitudinal axis and has first and second slots for receiving an adjustable strap and a rim defining a housing having an opening for receiving the engaging portion, the housing opening extending in a direction that is transversal to the longitudinal axis of the buckle. The rim is configured to allow sliding engagement with the engaging portion in a direction that is transversal to the longitudinal axis of the buckle between a first position wherein a section of the rim retains the engaging portion in the rim housing for locking the buckle into the stud and a second position wherein the engaging portion is no longer retained in the rim housing for releasing the buckle from the stud.

34 Claims, 11 Drawing Sheets

(56) References Cited

U.S. PATENT DOCUMENTS

| | | | |
|---|---|---|---|
| 2011/0298227 | A1 | 12/2011 | Fiedler |
| 2014/0068843 | A1 | 3/2014 | Wegener |

* cited by examiner

ATTACHMENT SYSTEM FOR A HELMET

FIELD OF THE INVENTION

The invention relates generally to an attachment system for a helmet.

BACKGROUND

Buckles are used in various types of sports equipment to secure and adjust a fit of the sports equipment to a user wearing the sports equipment. For example, in hockey or lacrosse, a player secures the strap of the chin protector and facemask to a helmet by causing the buckles provided on the left and right ends of the strap to engage buckle mounts provided on the left and right sides of the helmet.

Generally, prior art buckles for helmets are provided in the form of snap buttons wherein a female member of a snap button, usually provided on the buckle, is selectively engaged with a male member of the snap button, usually provided on the buckle mount. For example, such a prior art buckle is illustrated in FIG. 1. This type of arrangement requires one to push the buckle onto the buckle mount in order to affix it thereto, as shown in FIG. 2. However, such prior art buckles have some drawbacks. For instance, pushing the buckle onto the buckle mount generally requires exerting significant strength on the buckle which may cause the user's finger to hurt as he/she applies pressure on the buckle. Moreover, pushing the buckle onto the buckle mount also causes the user's head to be pushed from the side, especially when engaging the buckle to the buckle mount requires significant strength. This is generally not comfortable for the user.

The present invention aims to alleviate at least in part some of these drawbacks. Similar issues may arise in other sport helmets, such as football, cycling or skateboarding helmets in which users use buckles to secure chin straps together or to secure straps to the helmet.

SUMMARY OF THE INVENTION

According to a first broad aspect, the invention provides an attachment system for a helmet, the system comprising a buckle and a stud, the buckle extending along a longitudinal axis and having first and second slots that are in a direction transversal to the longitudinal axis of the buckle for receiving a strap in a longitudinal axis of the buckle wherein a length of the strap is adjustable relative to the buckle, the stud being mounted to the helmet or to another strap and comprising an engaging portion, the buckle comprising a rim defining a housing having an opening for receiving the engaging portion, the housing opening extending in a direction that is transversal to the longitudinal axis of the buckle, the rim being configured to allow sliding engagement with the engaging portion in a direction that is transversal to the longitudinal axis of the buckle between a first position wherein a section of the rim retains the engaging portion in the rim housing for locking the buckle into the stud and a second position wherein the engaging portion is no longer retained in the rim housing for releasing the buckle from the stud.

According to another broad aspect, the invention provides an attachment system for a helmet, the system comprising a buckle and a stud, the buckle extending along a longitudinal axis and having first and second slots that are in a direction transversal to the longitudinal axis of the buckle for receiving a strap in a longitudinal axis of the buckle wherein a length of the strap is adjustable relative to the buckle, the stud being mounted to the helmet or to another strap and comprising an engaging portion, the buckle comprising a rim defining a housing having an opening for receiving the engaging portion of the stud, the housing opening extending in a direction that is transversal to the longitudinal axis of the buckle, the rim comprising a first material having a first rigidity and the engaging portion comprising a second material having a second rigidity, the first rigidity being less than the second rigidity, the rim being configured to allow sliding engagement with the engaging portion in a direction that is transversal to the longitudinal axis of the buckle between a first position wherein a section of the rim retains the engaging portion in the rim housing for locking the buckle into the stud and a second position wherein the engaging portion is no longer retained in the rim housing for releasing the buckle from the stud.

According to a further broad aspect, the invention provides an attachment system for a helmet, the system comprising a buckle and a stud, the buckle extending along a longitudinal axis and having first and second slots that are in a direction transversal to the longitudinal axis of the buckle for receiving a strap in a longitudinal axis of the buckle wherein a length of the strap is adjustable relative to the buckle, the stud being mounted to the helmet or to another strap and comprising an engaging portion having a head and a groove located below the head, the head having a head diameter and a head thickness and the groove having a groove diameter and a groove thickness, the buckle comprising a rim defining a housing having an opening for receiving the engaging portion, the housing opening extending in a direction that is transversal to the longitudinal axis of the buckle, the rim comprising a biasing section with first and second restricting points being spaced apart of a distance taken along the longitudinal axis of the buckle, the rim being configured to allow sliding engagement with the engaging portion in a direction that is transversal to the longitudinal axis of the buckle between first and second positions, wherein, in the first position, the distance between the first and second restricting points is slightly smaller than the groove diameter such that the engaging portion is retained in the rim housing for locking the buckle into the stud, and in the second position, the engaging portion is no longer retained in the rim housing for releasing the buckle from the stud.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF THE EMBODIMENTS

Figure 1:
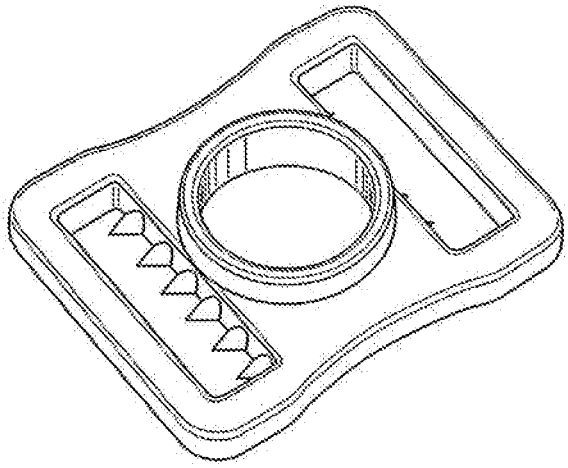
FIG. 1 (Prior Art)
FIGS. 1 and 2 show a prior art buckle and its implementation on a helmet.
Figure 2:
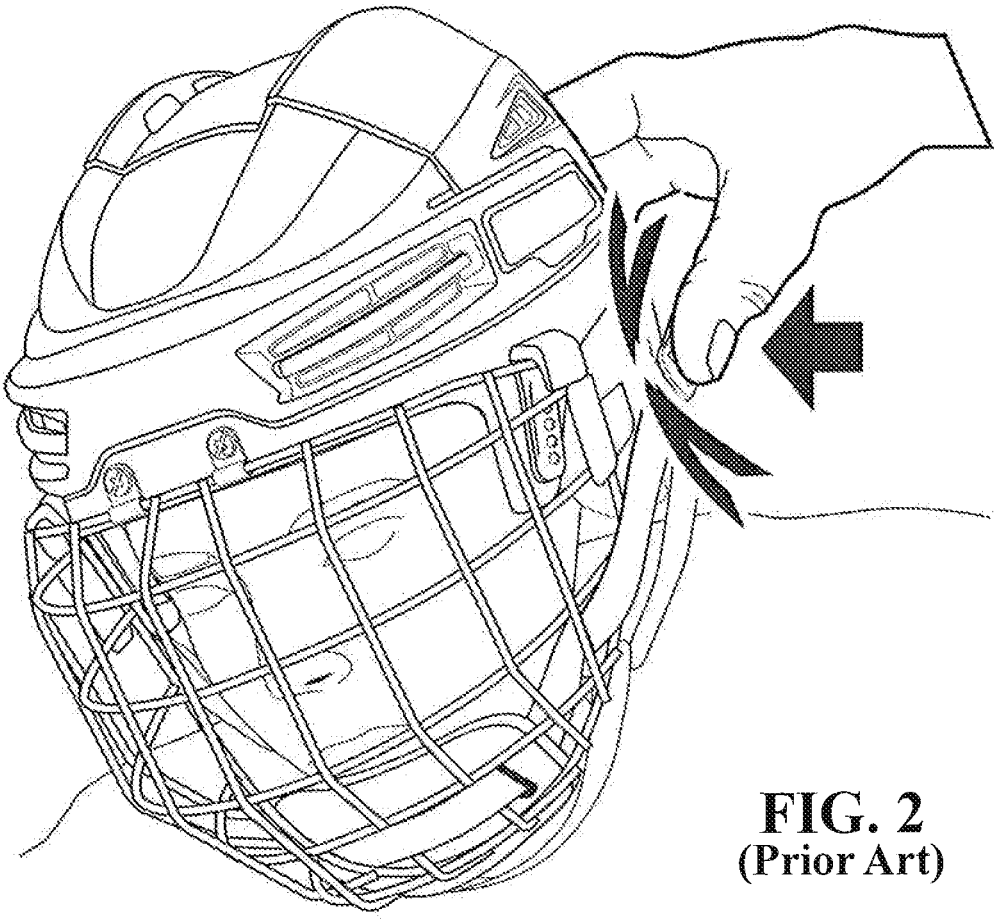
FIG. 2 (Prior Art)
Figure 3:
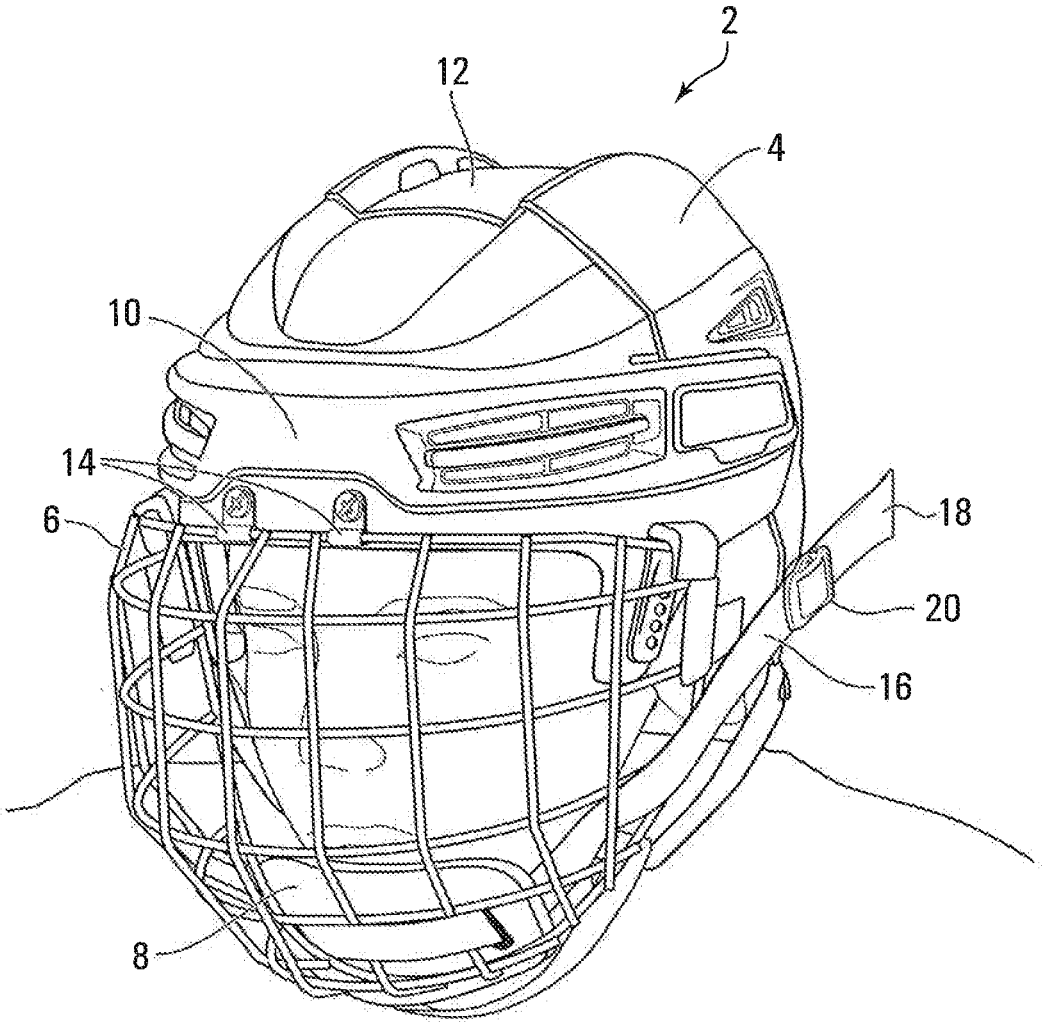
FIG. 3 is a perspective view of a helmet comprising a facemask, a chin protector, an adjustable strap and a left buckle in accordance with an embodiment of the invention, the left buckle being in a first (engaged) position.

FIG. 3 shows an example of a helmet 2 for wearing by a user. In this example, the helmet 2 is a hockey helmet for use by a hockey player. In this embodiment, the helmet 2 comprises an outer shell 4 for protecting the user's head, a facemask 6 for protecting the user's face and a chin protector 8. An inner side of the outer shell 4 (not shown) comprises padding elements for providing added comfort and impact absorption. In some embodiments, the helmet may not comprise one or more of the above components or may have one or more additional components.

The helmet 2 comprises a front portion 10 and a rear portion 12. The facemask 6 is mounted at the front portion 10 via hinged connections 14 such that the facemask 6 may be selectively opened or closed over the user's face. The helmet 2 may also comprise a plurality of ventilation apertures in order to allow air to circulate around the head of the user for providing added comfort to the user. The helmet may be a one-piece component or may comprise a plurality of interconnected members.

An adjustable chin strap 16 is provided in order to selectively secure the facemask 6 and chin protector 8 in a closed position. In this embodiment, the adjustable chin strap 16 is an elongated strip of fabric comprising ends 18 (only the left end is shown in the drawings). The strap 16 traverses openings in the chin protector 8 and overlaps a portion of wires of the facemask 6 such that the chin protector 8 and facemask 6 are retained together by the strap 16. A buckle 20 is provided proximate each end 18 of the strap 16, the buckle 20 being configured for interacting with the strap 16 in order to adjust a functional length of the strap 16 relative to the buckle 20 (i.e., a distance between the chin protector 8 and facemask 6 and the buckle 20) and the fit of the chin protector 8 and the facemask 6 with respect to the user's face, as will be discussed further below.

The strap 16 may be configured differently in other embodiments. For instance, in some embodiments, the strap may not extend from one side of the helmet 2 to the other side of the helmet 2. For example, the strap may be a left strap provided on the left side of the helmet 2 while a similar right strap is provided on the right side of the helmet 2.

Figure 4:
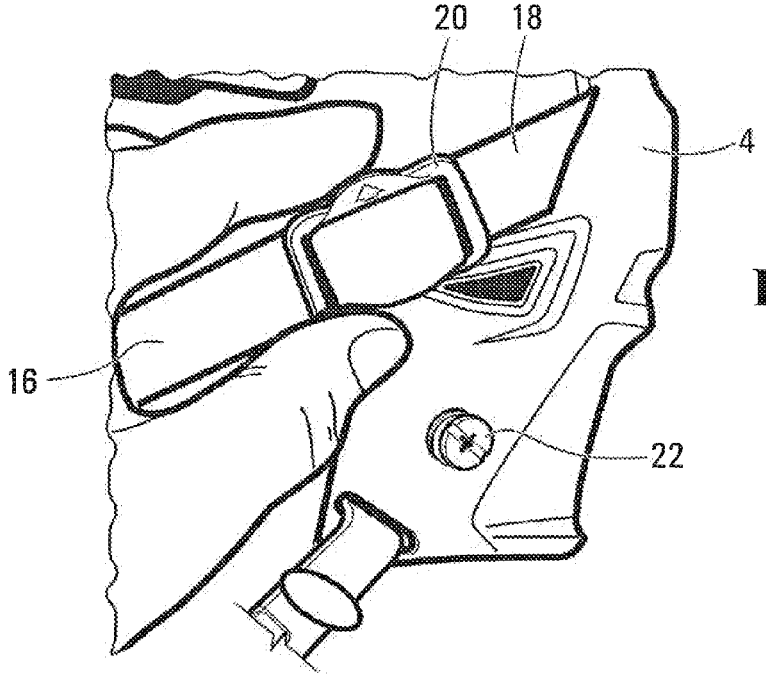
FIG. 4 is a fragmentary side view of the helmet of FIG. 3, showing the adjustable strap, the left buckle in a second (disengaged) position and a left stud mounted to the helmet.
Figure 5:
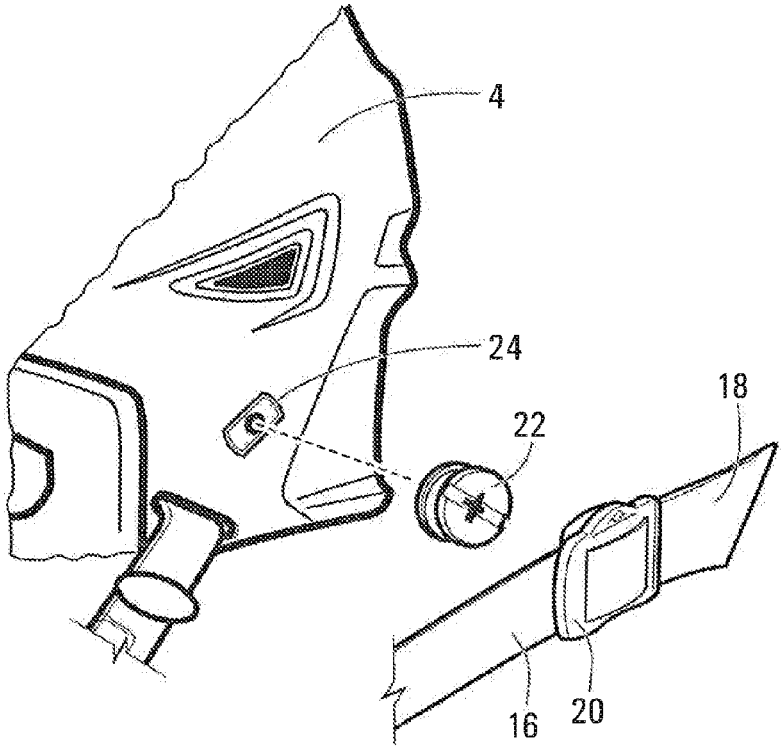
FIG. 5 is an enlarged view of the components of FIG. 4 where the left stud is removed from a mount inserted in the helmet shell.
Figure 6:
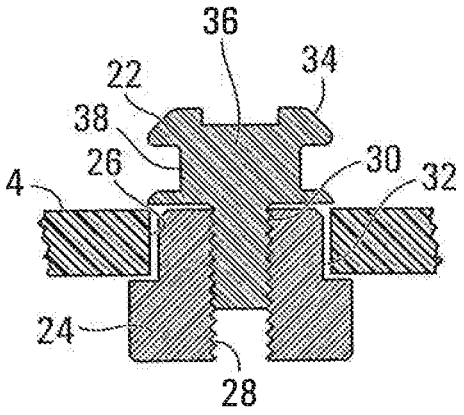
FIG. 6 is a cross-sectional view of the stud, mount and a portion of the helmet shell.

With additional reference to FIGS. 4 to 6, a stud 22 is mounted to the left side of the helmet 2. It is understood that a stud 22 is also mounted to the right side of the helmet 2. As best seen in FIGS. 5 and 6, the helmet also comprises a mount 24 at least partially received in an opening 26 of the outer shell 4. In this embodiment, the mount 24 has a generally cylindrical shape and comprises a centrally positioned fastener portion 28 for receiving a corresponding fastener portion 30 of the stud 22. A topmost portion 32 of the mount 24 is configured for being inserted into the opening 26 of the outer shell 4. To this end, the topmost portion 32 of the mount 24 has a shape similar to a shape of the opening 26, which is generally oblong in this embodiment but may be of any non-circular shape in other embodiments (e.g., square). The non-circular shape of the topmost portion 32 of the mount 24 can prevent a rotational motion of the mount 24 relative to the outer shell 4.

The mount 24 may be affixed to or embedded within a padding element (not shown) of the helmet 2. For example, the mount 24 may be adhesively bonded onto the padding element or the mount 24 may be at least partially contained within the padding element. The mount 24 may be affixed to the padding element in any other suitable way in other embodiments.

The stud 22 comprises the fastener portion 30 and engaging portion 34. The fastener portion 30 is operable to engage the fastener portion 28 of the mount 24. In this embodiment, the fastener portion 30 of the stud 22 is a threaded engaging member and the fastener portion 28 of the mount 24 is a corresponding threaded hole for receiving the threaded engaging member. The stud 22 may be mounted to the mount 24 in any other suitable way in other embodiments.

Figure 7:
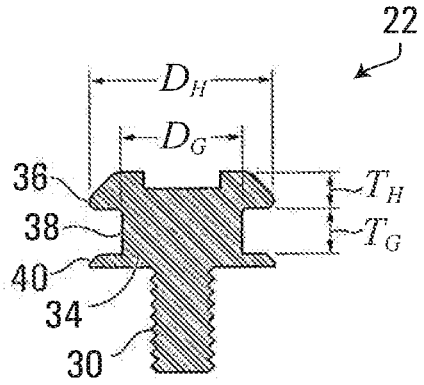
FIG. 7 is a cross-sectional view of the stud.

As best shown in FIG. 7, the engaging portion 34 of the stud 22 defines a head 36, a groove 38 below the head 36 and a base 40 below the groove 38. The head 36 defines a diameter $D_H$ and a thickness $T_H$. The groove 38 is located between the head 36 and the base 40 and defines a diameter $D_G$ and a thickness $T_G$. While in this embodiment, the base 40 has the same diameter than the diameter $D_H$ of the head 36 and a thickness that is smaller than the thickness $T_H$ of the head 36 or the thickness $T_G$ of the groove 38, in other embodiments, the diameter and the thickness of the base 41 may vary. The manner in which the buckle 20 engages stud 22 will be elaborated further below.

The stud 22 may be configured differently in other embodiments. For instance, in some embodiments, the stud 22 may not comprise a base at all. In such instances, the topmost portion 32 of the mount 24 may accomplish a similar role to the base 41.

In this embodiment, the stud 22 and mount 24 comprise metallic material (e.g., aluminum). In other embodiments, the stud 22 and mount 24 may comprise a different material such as plastic material or any other suitable material. Moreover, in some embodiments, the stud 22 and mount 24 may comprise different materials from one another, i.e., the stud 22 may comprise one material while the mount 24 may comprise another material. In one embodiment, the stud 22 and/or the engaging portion 34 may comprise a material having a modulus of elasticity $E_s$ that is approximately 69

GPa (i.e., the average modulus of elasticity of aluminum). The modulus elasticity $E_s$ of the material of the stud 22 may have any other value in other embodiments.

Although in this embodiment the stud 22 can be selectively attached and detached from the helmet 2 (e.g., by fastening and unfastening the stud 22 to the mount 24), in other embodiments, the stud may be configured to be permanently affixed to the helmet 2.

Figure 8A:
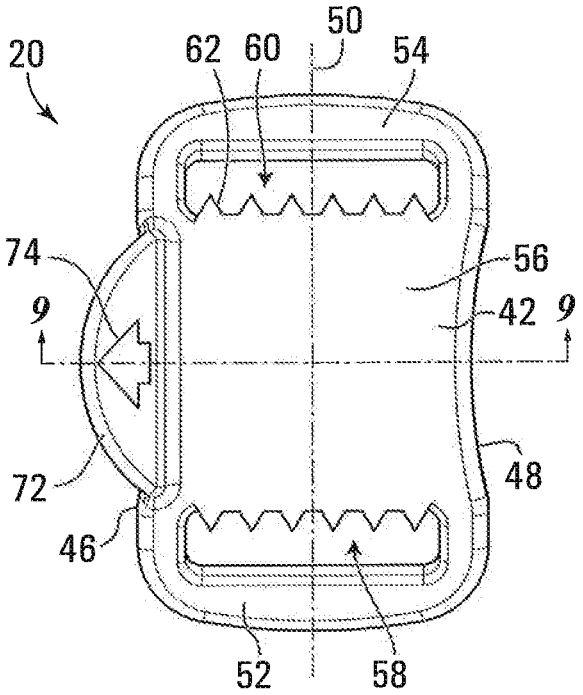
FIGS. 8A and 8B are front and bottom views of the buckle.
Figure 8B:
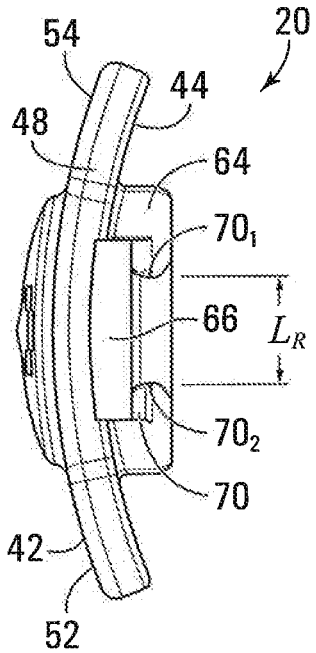

With additional reference to FIGS. 8A and 8B, the buckle 20 comprises a front side 42, a rear side 44, a top side 46 and a bottom side 48. As shown in FIG. 8A, the buckle 20 extends along a longitudinal axis 50 from a first end portion 52 to a second end portion 54 and defines a body portion 56 therebetween. In order to interact with the adjustable strap 16 of the helmet 2, the buckle 20 also comprises first and second slots 58, 60 positioned adjacent the first and second end portions 52, 54 respectively and being in a direction transversal to the longitudinal axis 50. In this embodiment, the slots 58, 60 are provided with protrusions 62 (e.g., teeth) for providing better retention of the adjustable strap 16.

In order to engage the strap 16 with the buckle 20, the distal end of the end 18 of the strap 16 is inserted into the first slot 58 from the rear side 44 of the buckle 20 and then inserted into the second slot 60 from the front side 42 of the buckle 20. Pulling on the distal end of the end 18 of the strap 16 causes the strap 16 to slide along the longitudinal axis 50 of the buckle 20, causing a reduction in a distance between the chin protector 8 and facemask 6 and the buckle 20 (i.e., the functional length of the strap 16) and thus tightening the fit of the chin protector 8 and facemask 6. Conversely, pulling on the strap 16 at a portion opposite the distal end of the end 18, i.e., a portion on the other side of the buckle 20, causes an increase in the distance between the chin protector 8 and facemask 6 and the buckle 20 and thus a loosening of the fit of the chin protector 8 and facemask 6. As such, the engagement between the buckle 20 and the strap 16 provides adjustability to the fit of the chin protector 8 and facemask 6 with respect to the user's face.

Figure 9:
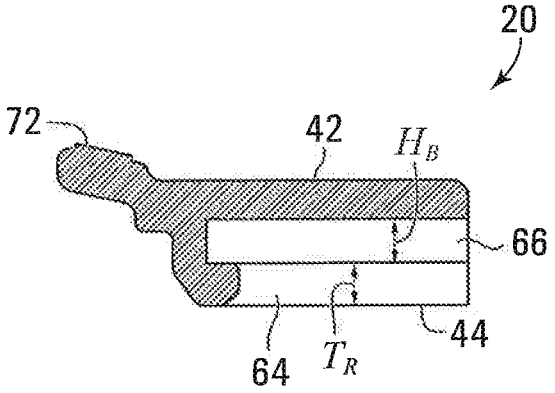
FIG. 9 is a cross-sectional view of the buckle taken along line 9-9.
Figure 10:
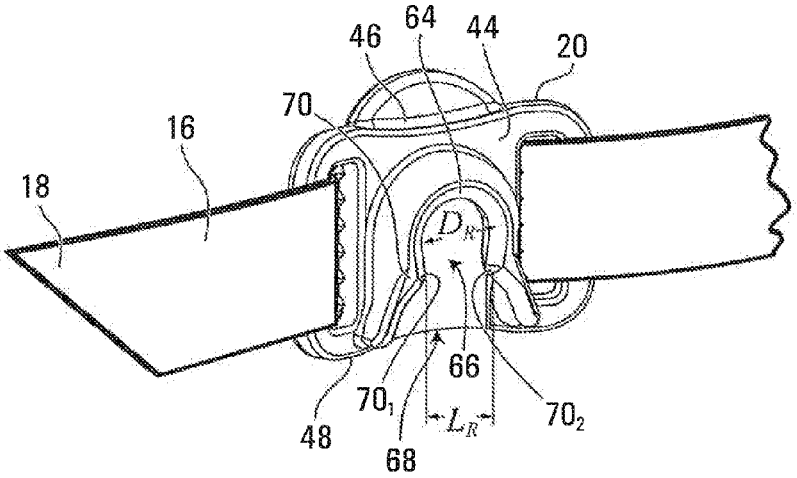
FIG. 10 is a rear perspective view of the buckle and a portion of the adjustable strap.
Figure 11:
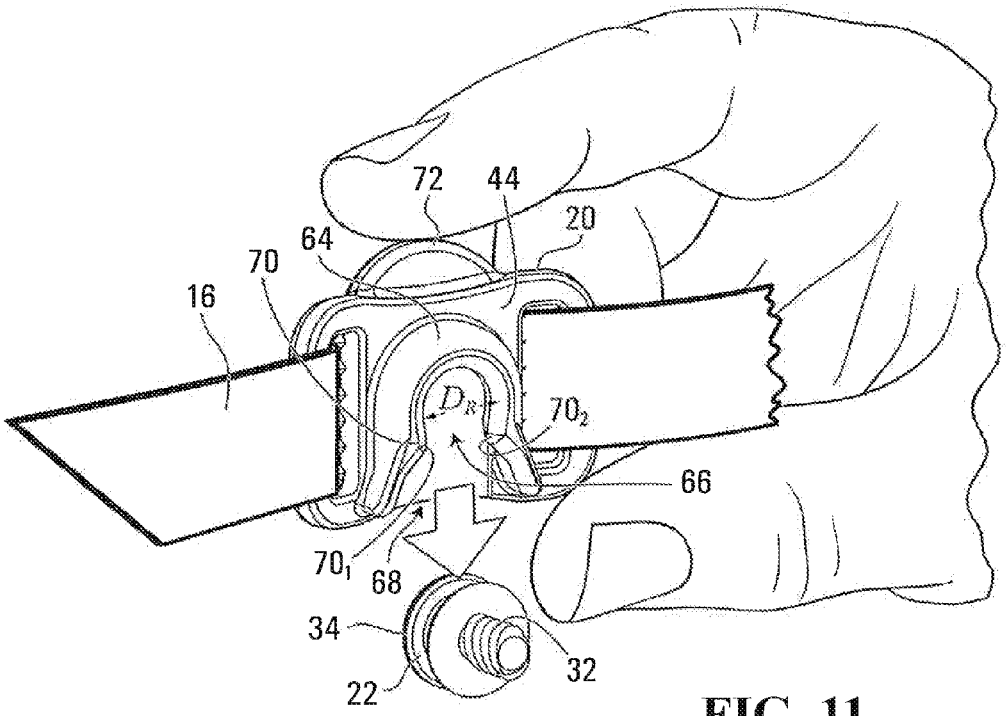
FIG. 11 shows the buckle and strap portion of FIG. 10 with the stud and the arrow showing engagement movement of the buckle towards the stud.

On its rear side 44, with additional reference to FIGS. 8 to 11, the buckle 20 comprises on the body portion 56 a rim 64 located between the first and second slots 58, 60 and defining a rim housing 66 for receiving the engaging portion 34 of the stud 22 (i.e. the head 36 and/or groove 38). The rim 64 has a shape similar to that of the engaging portion 34 (i.e., circular), however, as best shown in FIGS. 10 and 11, the rim housing 66 has a diameter $D_R$ that is slightly bigger than the diameter $D_G$ of the groove 38 ($D_R>D_G$) but that is smaller than the diameter $D_H$ of the head 36 ($D_R<D_H$). As best seen in FIG. 9, the rim 64 also has a thickness $T_R$ which is slightly smaller than the thickness $T_G$ of the groove 38 ($T_R<T_G$). The rim 64 further defines a housing opening 68 extending in a direction transversal to the longitudinal axis 35 of the buckle 20. In this embodiment, the housing opening 68 is located adjacent the bottom side 48 of the buckle 20 and serves as a channel leading towards and into the rim housing 66.

The rim 64 also comprises a biasing section 70 that is configured to elastically deform when subjected to a certain force. That is, the biasing section 70 can deform (e.g., widen) when a certain force is applied at the biasing section 70 and readopt its original form (e.g., retract) when the certain force is no longer applied. In this embodiment, the biasing section 70 comprises two restricting points $70_1$, $70_2$ which can provide the biasing section 70 with biasing functionality. In this example, the biasing section 70 is operable to deform in the longitudinal direction of the buckle 20 such that a longitudinal distance between the two restricting points $70_1$, $70_2$ of the biasing section 70 can vary depending on the force which is applied at the biasing section 70. As best seen in FIGS. 8B and 10, the two restricting points $70_1$, $70_2$ of the biasing section 70 define an "at-rest" longitudinal distance $L_R$ between them when no force is applied at the biasing section 70. In this embodiment, the at-rest longitudinal distance $L_R$ between the two restricting points $70_1$, $70_2$ of the biasing section 70 is slightly smaller than the diameter $D_G$ of the groove 38 ($L_R<D_G$).

As best shown in FIG. 9, the rim housing 66 defines a height $H_B$ that may alternatively or additionally be slightly smaller than the thickness $T_H$ of the head 36 of the engaging portion 34 when no force is applied on the buckle 20.

As best shown in FIG. 8A, the buckle 20 also comprises an indicator portion 72 which is indicative of a direction in which the buckle 20 may be engaged or disengaged from the engaging portion 34. The indicator portion 72 comprises a sign 74 showing a direction in which the buckle 20 may be engaged or disengaged from the engaging portion 34. This may help the user more easily and/or quickly engage or disengage the buckle 20 from the engaging portion 34. In this embodiment, the sign 74 is an arrow showing the direction of sliding movement of the buckle 20 towards the second position (disengaged position). In other embodiments, the housing opening may be located adjacent the top side of the buckle 20 while the indicator portion is located adjacent the bottom side of the buckle 20.

The buckle 20 and/or the rim 64 and/or the biasing section 70 comprises a biasing material that may comprise plastic material. More particularly, in this embodiment, the biasing material comprises polyoxymethylene (POM). The buckle 20 and/or the rim 64 and/or the biasing section 70 may comprise any other plastic material (e.g., nylon, polypropylene) or any other suitable material. The biasing material may have a modulus of elasticity $E_b$ that is approximately 3 GPa (i.e., the average modulus of elasticity of polyoxymethylene). The modulus of elasticity $E_b$ may have any other value in other embodiments.

The modulus of elasticity $E_b$ of the biasing material of the buckle 20 and/or the rim 64 and/or the biasing section 70 is smaller than the modulus of elasticity $E_s$ of the material of the stud 22 and/or engaging portion 34 (i.e. the head 36 and/or groove 38). In other words, the biasing material of the buckle 20 and/or the rim 64 and/or the biasing section 70 is less rigid than the material of the stud 22 and/or engaging portion 24, i.e., deforms more easily. The biasing material of the buckle 20 is especially useful at the rim 64 to provide biasing functionality at the biasing section 70. As such, in some embodiments, the biasing material may be confined to the rim 64 instead of the entirety of the buckle 20. In any case, the biasing material of the buckle 20 and/or the rim 64 and/or the biasing section 70 has a rigidity which is less than a rigidity of the material of the stud 22 and/or engaging portion 34.

In a similar manner, in some embodiments, a hardness of the biasing material of the buckle 20 and/or the rim 64 and/or the biasing section 70 may be smaller than a hardness of the material of the stud 22 and/or engaging portion 34 (i.e. the head 36 and/or groove 38).

Figure 15:
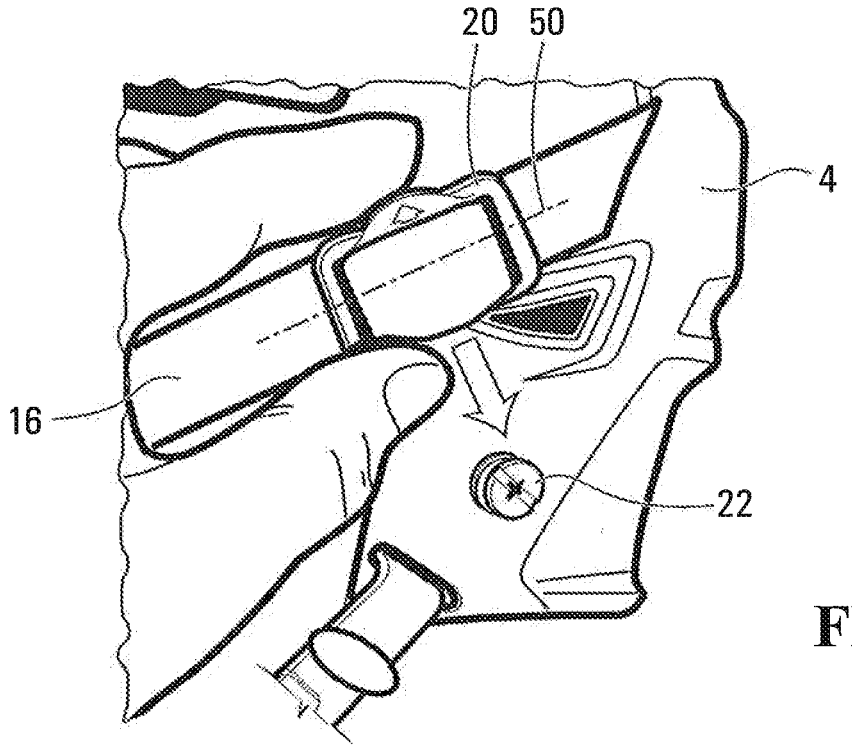
FIGS. 15 and 16 show how the buckle is to be engaged and disengaged with the stud respectively, the arrows showing sliding engagement movements.

In order to secure the buckle 20 to the stud 22, as shown in FIGS. 11 and 15, the user aligns the housing opening 68 of the buckle 20 with the stud 22 and slides the rim 64 of the buckle 20 into the groove 38 of the engaging portion 34 such that the head 36 of the engaging portion 34 is received into the rim housing 66 of the buckle 20 and the buckle 20 and rim 64 are in the first position where a section of the rim 64 retains the engaging portion 34 of the stud 22 for locking the buckle 20 onto the stud 22.

Figure 12:
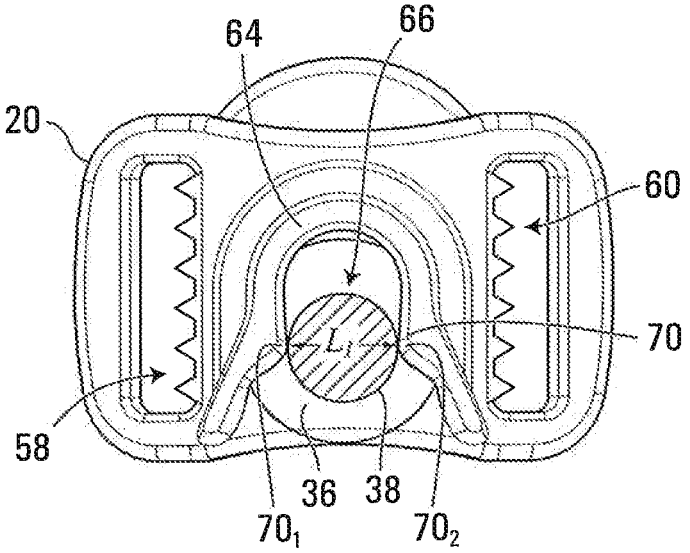
FIG. 12 is a rear view of the buckle where a section of a rim of the buckle is engaged into the stud, the stud being shown partially broken.
Figure 13:
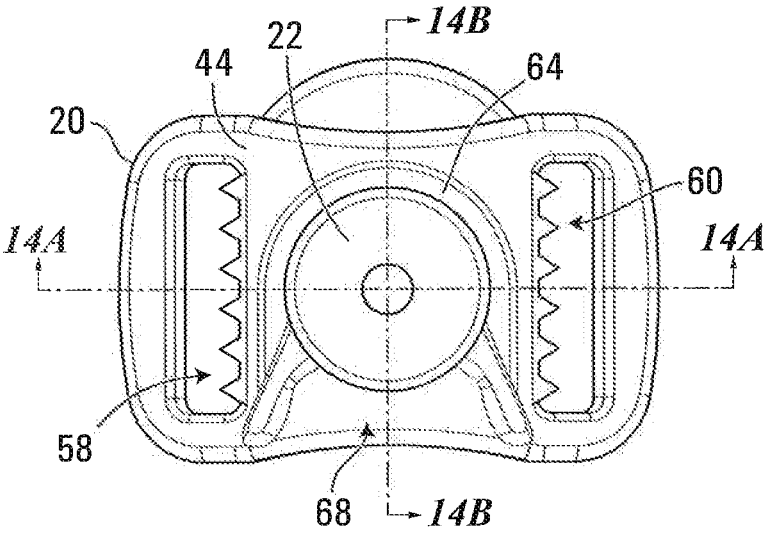
FIG. 13 is a rear view of the buckle in the first position where the section of the rim retains the stud in the rim housing for locking the buckle into the stud.
Figure 14A:
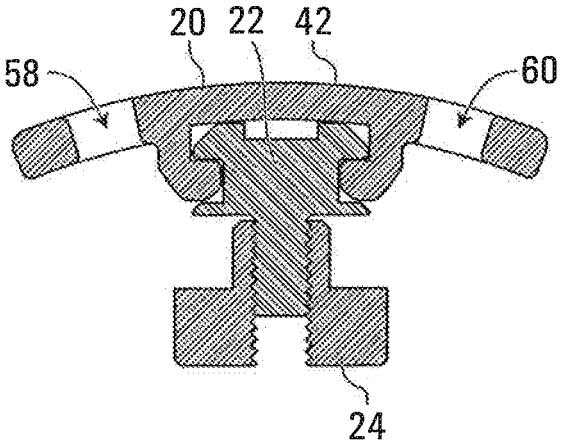
FIG. 14A is a cross-sectional view of the buckle and stud taken along line 14A-14A.
Figure 14B:
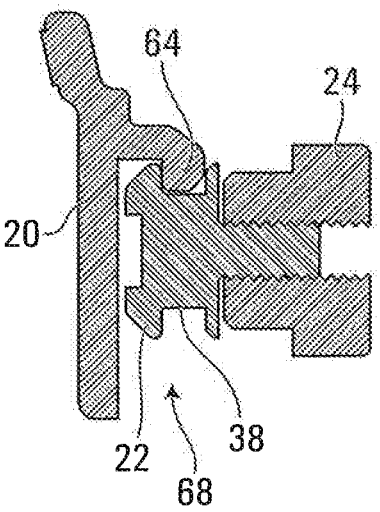
FIG. 14B is a cross-sectional view of the buckle and stud taken along line 14B-14B.

More specifically, as the user slides the buckle 20 onto the stud 22, the groove 38 of the engaging portion 34 contacts the rim 64 at the biasing section 70. The biasing section 70 resists a progression of the groove 38 further into the buckle 20 to a certain extent since the at-rest longitudinal distance $L_R$ between the two restricting points $\mathbf{70}_1$, $\mathbf{70}_2$ is slightly smaller than the diameter $D_G$ of the groove 38. As the user increases a force that he/she applies onto the buckle 20, the biasing section 70 widens in order to slide over the groove 38. As best shown in FIG. 12, as a result of the increased force, the longitudinal distance between the restricting points $\mathbf{70}_1$, $\mathbf{70}_2$ of the biasing section 70 increases to an increased distance $L_I$ ($L_I > L_R$). The biasing section 70 retracts once it has overcome the largest part of the groove 38, i.e., the diameter $D_G$ of the groove 38. In other words, the longitudinal distance between the restricting points $\mathbf{70}_1$, $\mathbf{70}_2$ decreases back to the at-rest longitudinal distance $L_R$ once the diameter $D_G$ of the groove 38 has been forced past the biasing section 70. In the first position, as shown in FIGS. 13, 14A and 14B, the head 36 of the engaging portion 34 is contained in the rim housing 66 and the buckle 20 is locked onto the stud 22 since removing the buckle 20 from engagement with the stud 22 requires applying an increased force in the opposite transversal direction in order to overcome the resistance posed by the biasing section 70. As such, in the first position, the biasing section 70 retains the head 36 of the stud 22 in the rim housing 66.

In embodiments where the height $H_B$ of the biasing section 70 is slightly smaller than the thickness $T_H$ of the head 36, the biasing section 70 may similarly be operable to deform under force and thus increase its height $H_B$ in order to slide over the head 36 of the engaging portion 34.

Figure 16:
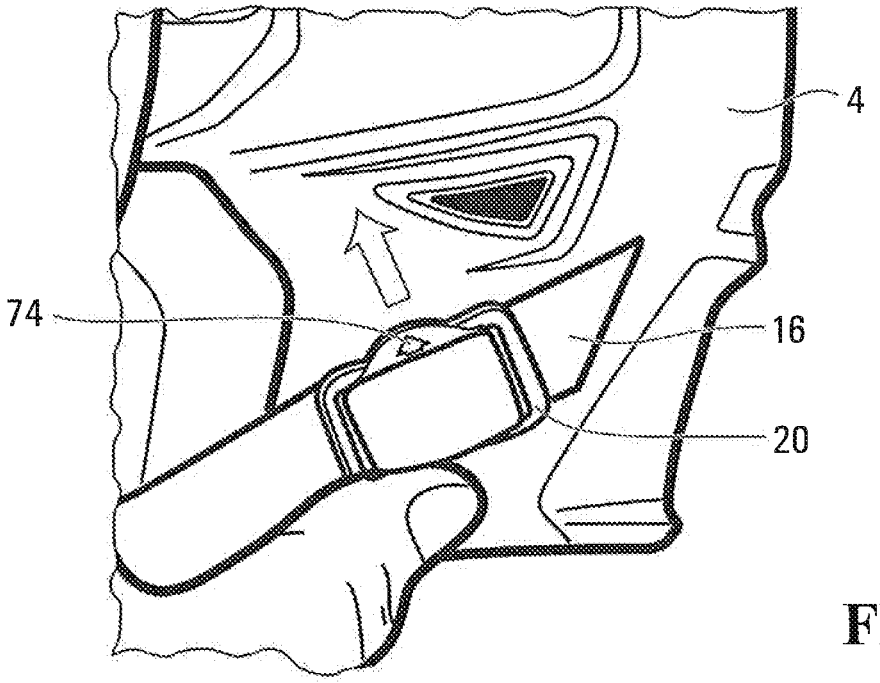

In order to remove the buckle 20 from engagement with the stud 22, as shown in FIG. 16, the user slides the buckle 20 in a direction opposite to the housing opening 68 and thus towards the top side 46 of the buckle 20 from the first engaged position to the second disengaged position where the engaging portion 34 of the stud 22 will no longer be retained in the rim housing 66 for releasing the buckle 20 from the stud 22. To this effect, as the groove 38 contacts the biasing section 70 and the user increases the force he/she applies on the buckle 20, the biasing section 70 expands to slide over the largest part of the groove 38, i.e., the diameter $D_G$ of the groove 38. In other words, the longitudinal distance between the two restrictive points $\mathbf{70}_1$, $\mathbf{70}_2$ of the biasing section 70 increases to the increased distance $L_I$. As the stud 22 is cleared through the housing opening 68, and the head 36 is no longer retained in the rim housing 66, the biasing section 70 retracts again, i.e., the longitudinal distance between the two restrictive points $\mathbf{70}_1$, $\mathbf{70}_2$ returns to the at-rest longitudinal distance $L_R$.

The buckle 20 is configured to allow sliding engagement with the stud 22 in a direction transversal to the longitudinal axis 50 of the buckle and also generally transversal to a direction of a force applied when the facemask 6 is impacted or pulled, which is generally a front-to-back direction. This may prevent accidental disengagement of the buckle 20 with the stud 22. For example, if the facemask 6 is pulled frontwardly or pushed rearwardly, the force will be applied generally in a longitudinal direction of the helmet 2. Since the housing opening 68 is the only way through which the buckle 20 can become disengaged from the stud 22 and the housing opening 68 is located adjacent the bottom side 48 of the buckle 20, applying a force in a longitudinal direction that is generally parallel to the longitudinal direction of the buckle 20 cannot disengage the buckle 20 from the stud 22. Instead, as discussed above, a force strong enough to overcome the resistance posed by the biasing section 70 must be applied in a direction transversal to the longitudinal direction of the buckle 20 (to the longitudinal axis 50) in order for the buckle 20 to become disengaged from the stud 22.

As described above, the interaction between the buckle 20 and the stud 22 may rely at least in part on the different dimensions that were defined in respect of the rim 64, the rim housing 66, the biasing section 70, and the engaging portion 34 of the stud 22 (i.e. the head 36 and/or groove 38). For example, as mentioned earlier, the at-rest longitudinal distance $L_R$ between the two restrictive points $\mathbf{70}_1$, $\mathbf{70}_2$ of the biasing section 70 is slightly smaller than the diameter $D_G$ of the groove 38 of the engaging portion 34 of the stud 22. However, if the at-rest longitudinal distance $L_R$ is too small with respect to the diameter $D_G$ of the groove 38, the biasing material of the buckle 20 may not be able to elastically deform sufficiently to allow the stud 22 into the rim housing 66. As such, the at-rest longitudinal distance $L_R$ has a tolerance with respect to the diameter $D_G$ of the groove 38 which defines how much smaller than the diameter $D_G$ the at-rest longitudinal distance $L_R$ can be. For instance, in some cases, the tolerance of the at-rest longitudinal distance $L_R$ with respect to the diameter $D_G$ of the groove 38 may be up to 2%. That is, the at-rest longitudinal distance $L_R$ may be up to 2% smaller than the diameter $D_G$ of the groove 38. In some cases this tolerance may be between 2% to 4%, in some cases between 4% to 6%, and in some cases even up to 8%. Similarly, in some embodiments, the height $H_B$ of the biasing section 70 of the rim 64 has a tolerance with respect to the thickness $T_H$ of the head 36 of the engaging portion 34 of the stud 22. For instance, in some cases the tolerance of the height $H_B$ of the biasing section 70 with respect to the thickness $T_H$ of the head 36 may be up to 2%. That is, in some cases, the height $H_B$ of the biasing section 70 may be up to 2% smaller than the thickness $T_H$ of the head 36. In some cases this tolerance may be between 2% to 4%, in some cases between 4% to 6%, and in some cases even up to 8%.

Figure 17:
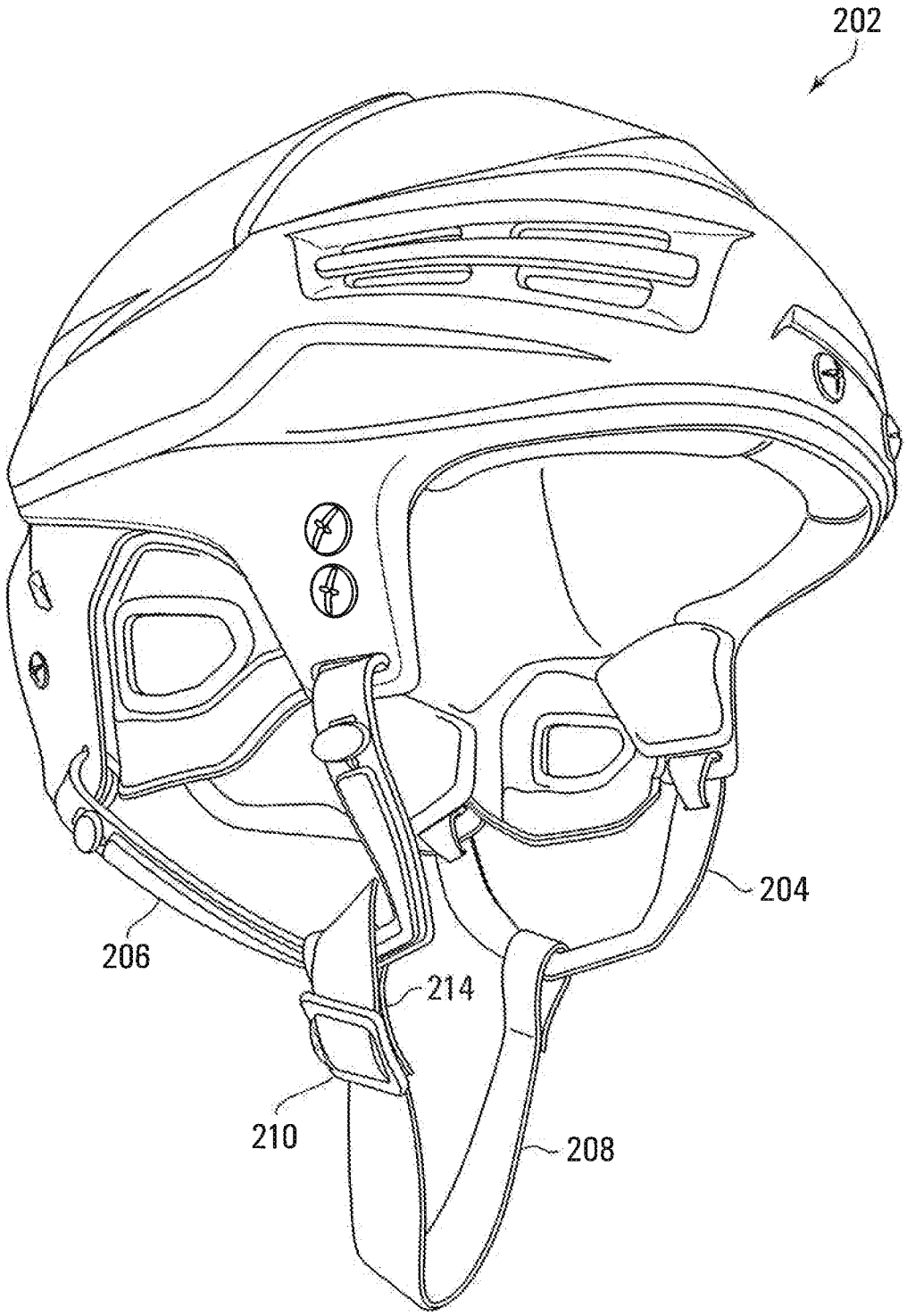
FIGS. 17 and 18 show a variant of the invention in which the buckle is mounted to an adjustable chin strap and the stud is mounted to another chin strap.
Figure 18:
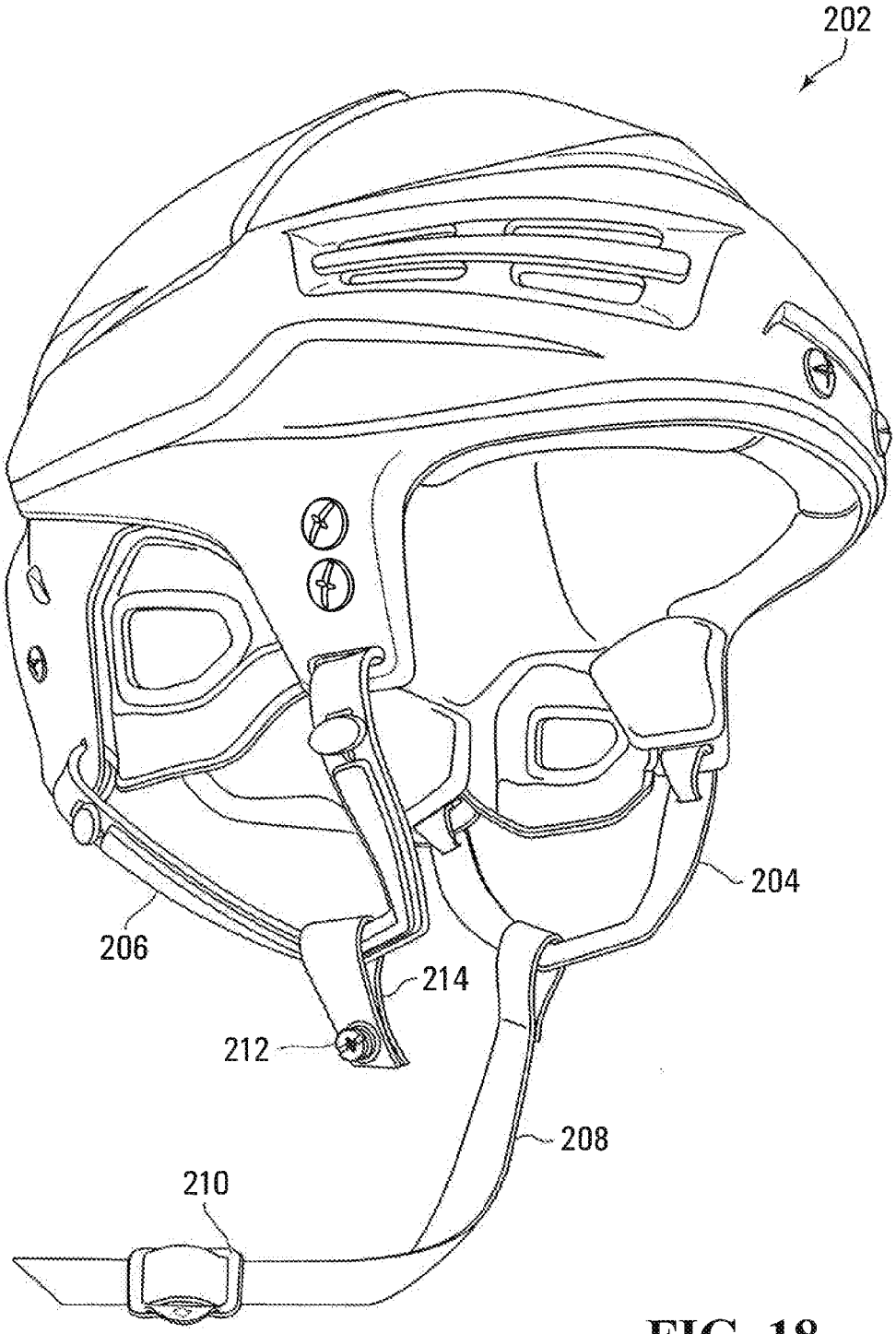

FIGS. 17 and 18 show a helmet 202 that does not comprise a facemask or a chin protector and that may comprise a visor that covers at least the eyes of the user. The helmet 202 comprises left and right ear loops 204, 206 on the left and right sides of the helmet, an adjustable chin strap 208 with a proximal end connected to the ear loop 204, a buckle 210 for securing the adjustable chin strap 208 and for providing functional length adjustment of the strap 208 relative to the buckle 210 (i.e., adjustment of the distance between the ear loop 204 and the buckle 210), and a stud 212 mounted to a chin strap 214 having a proximal end connected to the ear loop 206.

The adjustable chin strap 208 is thus permanently affixed to the ear loop 204. This can be achieved by affixing an end of the adjustable chin strap 208 onto itself around the ear loop 204 via stitching or ultrasonic welding for example. On the opposite side of the helmet 202, the chin strap 214 is also permanently affixed to the ear loop 206 in a similar way as the adjustable chin strap 208 is affixed to the ear loop 204. The chin strap 214 is "fixed" in that its length cannot be modified by the user whereas the adjustable chin strap 208 is "adjustable" in that its functional length (i.e., the distance between the ear loop 204 and the buckle 210) is adjustable by the user by way of its interaction with the buckle 210.

As best shown in FIG. 18, the stud 212 is provided on a front side of the chin strap 214.

The buckle 210 is similar to the buckle 20. For example, the buckle 210 comprises a housing and a housing opening for interacting with a engaging portion of the stud 212. The user of the helmet 202 may adjust the length of the adjustable chin strap 208 via its engagement with the buckle 210 in a similar manner to that described above in respect of the strap 16, allowing the user to adjust the length of the chin strap 208 with respect to his/her chin.

Similarly to the buckle 20 described above, the buckle 210 may be slid in and out of engagement with the engaging portion of the stud 212 (e.g., in a direction indicated by a sign or an indicator portion of the buckle 220). This provides an easy way to secure the buckle 210 to the stud 212 and thus to secure the helmet 202 onto the user's head.

In some embodiments, the buckle 20 and the buckle 210 may be configured to allow both a sliding engagement and a snapping engagement with a respective stud. For instance, taking the buckle 20 as an example, the rim housing of the buckle may be dimensioned as previously described to allow the buckle to slideably engage the stud and, additionally, also be dimensioned such that buckle may be snapped or unsnapped from the stud in a more traditional way. In such an embodiment, the diameter $D_H$ of the head has a tolerance relationship with respect to the diameter $D_R$ of the rim housing which defines how much smaller the diameter $D_R$ of the rim housing can be relative to the diameter $D_H$ of the head. For instance, in some cases, the tolerance of the diameter $D_R$ with respect to the diameter $D_H$ of the head may be up to 2%. That is, the diameter $D_R$ may be up to 2% smaller than the diameter $D_H$ of the head. In some cases this tolerance may be between 2% to 4%, in some cases between 4% to 6%, and in some cases even up to 8%. As such, the buckle may be provided with dual functionality that allows the buckle to slideably engage and disengage the stud and also to be used in a more traditional way which involves snapping and unsnapping the buckle from the stud.

Any feature of any embodiment discussed herein may be combined with any feature of any other embodiment discussed herein in some examples of implementation. Certain additional elements that may be needed for operation of certain embodiments have not been described or illustrated as they are assumed to be within the purview of those of ordinary skill in the art.

Moreover, certain embodiments may be free of, may lack and/or may function without any element that is not specifically disclosed herein. Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. In combination:

a helmet;

a stud connected to a part of the helmet and comprising an engaging portion; and a buckle comprising first and second slots for receiving a strap, an axis of the buckle extending from the first slot to the second slot, a length of the strap being adjustable relative to the buckle, the buckle comprising a rim defining a housing having an opening for receiving the engaging portion of the stud, the opening of the housing extending transversally to the axis of the buckle, the rim being configured to allow sliding engagement with the engaging portion of the stud transversally to the axis of the buckle between a first position wherein a section of the rim retains the engaging portion of the stud in the housing for locking the buckle onto the stud and a second position wherein the engaging portion of the stud is no longer retained in the housing for releasing the buckle from the stud, wherein the section is configured to elastically deform for allowing sliding movement of the buckle between the first and second positions.

2. The combination of claim 1, wherein the engaging portion of the stud comprises a head and a groove located below the head, the head having a head diameter and a head thickness and the groove having a groove diameter and a groove thickness.

3. The combination of claim 2, wherein the section comprises first and second restricting points being spaced apart of a distance taken along the axis of the buckle, the distance being slightly smaller than the groove diameter such that the head is retained in the housing in the first position.

4. The combination of claim 3, wherein the housing has a housing diameter being slightly bigger than the groove diameter and slightly smaller than the head diameter such that the head is retained in the housing in the first position.

5. The combination of claim 4, wherein the housing has a housing thickness that is slightly smaller than the groove thickness such that the head is retained in the housing in the first position.

6. The combination of claim 1, wherein the rim comprises a first material having a first rigidity and the stud comprises a second material having a second rigidity, the first rigidity being less than the second rigidity.

7. The combination of claim 1, wherein the buckle extends along its axis from a first end portion to a second end portion with a body portion therebetween, the first slot being adjacent the first end portion, the second slot being adjacent the second end portion, and the rim being provided on the body portion.

8. The combination of claim 7, wherein the buckle has a top side and a bottom side opposite to the top side, the top and bottom sides being generally parallel to the axis of the buckle, wherein the opening of the housing is on the bottom side, and wherein the top side has an indicator portion for illustrating a movement direction of the buckle.

9. The combination of claim 8, wherein the indicator portion has an arrow showing movement direction of the buckle from the first position to the second position.

10. The combination of claim 1, wherein the strap remains attached to a remainder of the helmet when the buckle is disengaged from the stud.

11. The combination of claim 1, wherein the axis of the buckle is a longitudinal axis of the buckle.

12. In combination:

a helmet;

a stud connected to a part of the helmet and comprising an engaging portion; and a buckle comprising first and second slots for receiving a strap, an axis of the buckle extending from the first slot to the second slot, a length of the strap being adjustable relative to the buckle, the buckle comprising a rim defining a housing having an opening for receiving the engaging portion of the stud, the opening of the housing transversally to the axis of the buckle, the rim comprising a first material having a first rigidity and the engaging portion of the stud comprising a second material having a second rigidity, the first rigidity being less than the second rigidity, the rim being configured to allow sliding engagement with the engaging portion transversally to the axis of the buckle between a first position wherein a section of the rim retains the engaging portion of the stud in the housing for locking the buckle onto the stud and a second position wherein the engaging portion of the stud is no longer retained in the housing for releasing the buckle from the stud, wherein the section is configured to elastically deform for allowing sliding movement of the buckle between the first and second positions.

13. The combination of claim 12, wherein the axis of the buckle is a longitudinal axis of the buckle.

14. In combination:

a helmet;

a stud connected to a part of the helmet and comprising an engaging portion having a head and a groove located below the head, the head having a head diameter and a head thickness and the groove having a groove diameter and a groove thickness; and a buckle comprising first and second slots for receiving a strap, an axis of the buckle extending from the first slot to the second slot, a length of the strap being adjustable relative to the buckle, the buckle comprising a rim defining a housing having an opening for receiving the engaging portion of the stud, the opening of the housing extending transversally to the axis of the buckle, the rim comprising a biasing section with first and second restricting points being spaced apart of a distance taken along the axis of the buckle, the rim being configured to allow sliding engagement with the engaging portion of the stud transversally to the axis of the buckle between first and second positions, wherein, in the first position, the distance between the first and second restricting points is slightly smaller than the groove diameter such that the engaging portion of the stud is retained in the housing for locking the buckle onto the stud, and in the second position, the engaging portion of the stud is no longer retained in the housing for releasing the buckle from the stud.

15. The combination of claim 14, wherein the axis of the buckle is a longitudinal axis of the buckle.

16. A helmet for receiving a head of a wearer, the helmet comprising:

a) an outer shell;

b) padding disposed on an inner side of the outer shell for providing impact absorption; and c) an attachment system comprising a buckle and a buckle-retaining projection, the buckle being retainable onto the buckle-retaining projection without urging the buckle onto the buckle-retaining projection along a direction of projection of the buckle-retaining projection, the buckle being configured to slideably engage the buckle-retaining projection transversally to the direction of projection of the buckle-retaining projection to retain the buckle onto the buckle-retaining projection, the buckle having a section that is configured to elastically deform when the buckle-retaining projection is urged against it transversally to the direction of projection of the buckle-retaining projection.

17. The helmet of claim 16, wherein the buckle is configured to slideably disengage the buckle-retaining projection transversally to the direction of projection of the buckle-retaining projection to release the buckle from the buckle-retaining projection.

18. The helmet of claim 17, wherein the strap remains attached to a remainder of the helmet when the buckle is disengaged from the buckle-retaining projection.

19. The helmet of claim 16, wherein the buckle-retaining projection comprises a stud.

20. The helmet of claim 19, wherein the section is part of a rim of the buckle, the rim defining a housing having an opening for receiving an engaging portion of the stud.

21. The helmet of claim 19, wherein the stud comprises an enlarged head.

22. The helmet of claim 16, wherein the buckle comprises first and second slots for receiving the strap.

23. The helmet of claim 16, wherein the buckle is configured to slideably engage the buckle-retaining projection transversally to a longitudinal axis of the buckle.

24. The helmet of claim 16, wherein a length of the strap is adjustable relative to the buckle.

25. The helmet of claim 16, wherein the engaging portion of the stud comprises a head and a groove located below the head, the head having a head diameter and a head thickness and the groove having a groove diameter and a groove thickness.

26. The helmet of claim 16, wherein the section comprises first and second restricting points being spaced apart by a distance taken along an axis of the buckle, the distance being slightly smaller than the groove diameter such that the head is retained in the housing when the buckle is engaged with the stud.

27. The helmet of claim 26, wherein the housing has a housing diameter being slightly bigger than the groove diameter and slightly smaller than the head diameter such that the head is retained in the housing when the buckle is engaged with the stud.

28. The helmet of claim 27, wherein the housing has a housing thickness that is slightly smaller than the groove thickness such that the head is retained in the housing when the buckle is engaged with the stud.

29. The helmet of claim 16, wherein the rim comprises a first material having a first rigidity and the stud comprises a second material having a second rigidity, the first rigidity being less than the second rigidity such that a section of the rim is elastically deformable for allowing sliding movement of the buckle when the buckle is engaged onto the stud.

30. The helmet of claim 16, wherein the buckle comprises first and second slots for receiving the strap, the buckle comprising a proximal end portion, a distal end portion and a body portion therebetween, the first slot being adjacent the proximal end portion, the second slot being adjacent the distal end portion, and the rim being provided on the body portion.

31. The helmet of claim 30, wherein the buckle has a top side and a bottom side opposite to the top side, the housing comprising a housing opening on the bottom side of the buckle, and the top side has an indicator portion for illustrating a movement direction of the buckle.

32. The helmet of claim 31, wherein the indicator portion has an arrow showing the movement direction of the buckle.

33. The helmet of claim 16, wherein the helmet is a hockey or lacrosse helmet.

34. A helmet for receiving a head of a wearer, the helmet comprising:

a) an outer shell;

b) padding disposed on an inner side of the outer shell for providing impact absorption; and c) an attachment system comprising a buckle and a buckle-retaining projection, the buckle receiving a strap along an axis of the buckle, the buckle being configured to allow sliding engagement with the buckle-retaining projection in a direction that is (i) generally tangential to an outer surface of the outer shell at a location where the buckle-retaining projection projects relative to the outer surface of the outer shell and (ii) transversal to the axis of the buckle, the buckle having a section that is configured to elastically deform when the buckle-retaining projection is urged against it transversally to the direction of projection of the buckle-retaining projection.

* * * * *